US005458316A

United States Patent [19]

Engel

[11] Patent Number: 5,458,316

[45] Date of Patent: Oct. 17, 1995

[54] FLEXIBLE PROTECTIVE BOOT FOR A JACK SCREW

[75] Inventor: Darryl L. Engel, LaOtto, Ind.

[73] Assignee: Larry Kip, Butler, Ind.

[21] Appl. No.: 287,295

[22] Filed: Aug. 8, 1994

[51] Int. Cl.[6] ..... B66F 3/12

[52] U.S. Cl. ..... 254/126

[58] Field of Search ..... 254/122, 126, 254/7 B, 425, 424, DIG. 2

[56] References Cited

U.S. PATENT DOCUMENTS 1,714,464 5/1929 Merriman ..... 254/122

3,857,548 12/1974 Takeuchi .

5,002,258 3/1991 Gruber .

*Primary Examiner*—Robert C. Watson

*Attorney, Agent, or Firm*—Hill, Steadman & Simpson

[57] ABSTRACT

A flexible protective bellows or boot for the lead screw of a scissors jack which serves as a reservoir for grease and lubricant and which fits over the lead screw to lubricate it and also to protect the user of the jack from getting greasy. The flexible boot makes it feasible to store the jack in locations outside the trunk of the vehicle.

2 Claims, 2 Drawing Sheets

FLEXIBLE PROTECTIVE BOOT FOR A JACK SCREW

CROSS-REFERENCES TO RELATED APPLICATIONS

This application is an improvement on scissors jacks such as disclosed in application Ser. No. 08/084,129, filed Jul. 1,1993 now U.S. Pat. No. 5,356,117 entitled "Hollow Trunnions For Scissors Jack", assigned to the assignee of the present application in which the inventor is Darryl L. Engel.

BACKGROUND OF THE INVENTION

1. Field of the Invention

This invention relates in general to a flexible boot which fits around and encloses the screw of a jack such as a scissors jack for automobiles so as to maintain the screw lubricated and also to keep it free of dirt and debris and to keep the jack clean so that users can handle it without becoming dirty.

2. Description of Related Art

Automotive scissors jack for cars and light trucks are typically stowed in the trunk of the vehicle or in the passenger compartment of the vehicle. One of the reasons for so storing scissor jacks is they are protected from the weather and dirt in these locations. If a jack is exposed to the weather, corrosion such as rust occurs and the lubricant on the screw of the jack deteriorates. Some prior art scissors jacks have been stowed under the hood of a vehicle. However, such jacks are subject to corrosion and lubrication problems. When dirt or sand get on the screw of the jack, the grease becomes contaminated and early thread failure occurs which results in reduced jack life. Also, a user of the jack can easily come in contact with the lubricant on the screw of the jack so that they get grease on their hands or clothing.

SUMMARY OF THE INVENTION

The present invention comprises an automotive scissors jack wherein a flexible bellows of plastic or rubber or other suitable material is placed over the screw so as to cover the screw and to retain grease (lubricant) on the threads of the screw. The bellows also acts as a reservoir for retaining extra grease which would normally fall off the screw as the screw is run through the trunnion without the flexible bellows. The flexible bellows is formed with at least one end portion which fits over the trunnion and two slits are provided on such hollow end portion which allow the screw to pass through as the jack is raised, but when the screw is retracted into the trunnion, the opening closes, thus protecting the threaded trunnion and sealing off the screw. Such slits also aid in spreading the grease evenly onto the threads of the screw. Thus, the invention keeps the screw and not properly lubricated and clean.

A number of benefits result from the use of the boot or bellows of the present invention in that the invention maintains the threads on the screw and the trunnion greased so as to extend the expected life of the jack. The invention also prevents the users from getting grease on their hands or clothing since the greased screw is covered by the flexible bellows. The invention increases the safety of the jack because it prevents screw and nut failure.

It is an object of the present invention to provide a flexible bellows which covers the screw of a jack such as a scissors jack so as to keep the lubricant on the screw and also to protect users from the lubricant on the screw.

The invention makes it possible to store the jack outside of the trunk in that the flexible bellows or boot protects and lubricates the screw which has not been possible before.

Another object of the invention is to extend the useful life and increase the safety of use of a scissors jack by assuring that the threads of the screw and the trunnion are lubricated and maintained clean.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

DESCRIPTION OF THE PREFERRED EMBODIMENTS

Figure 1:
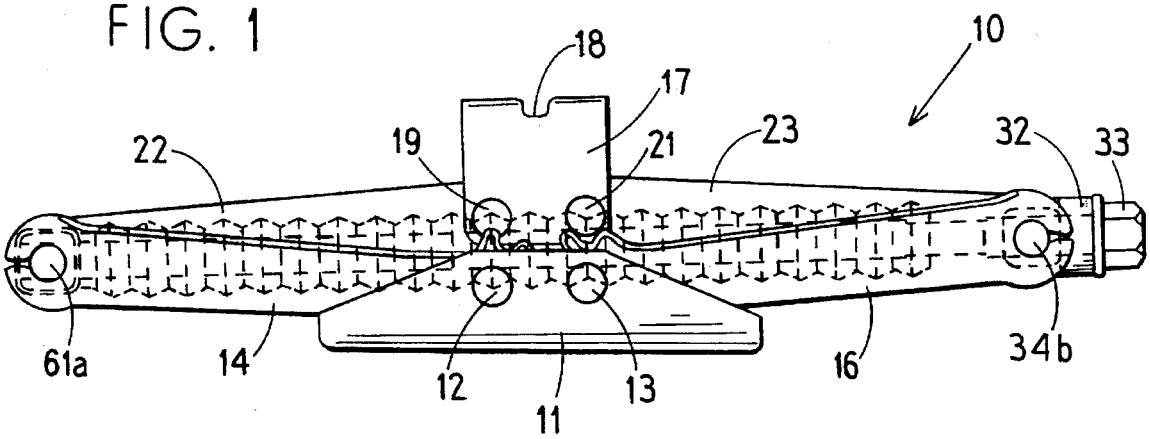
FIG. 1 is a side plan view of a scissors jack in the lowered position.
Figure 2:
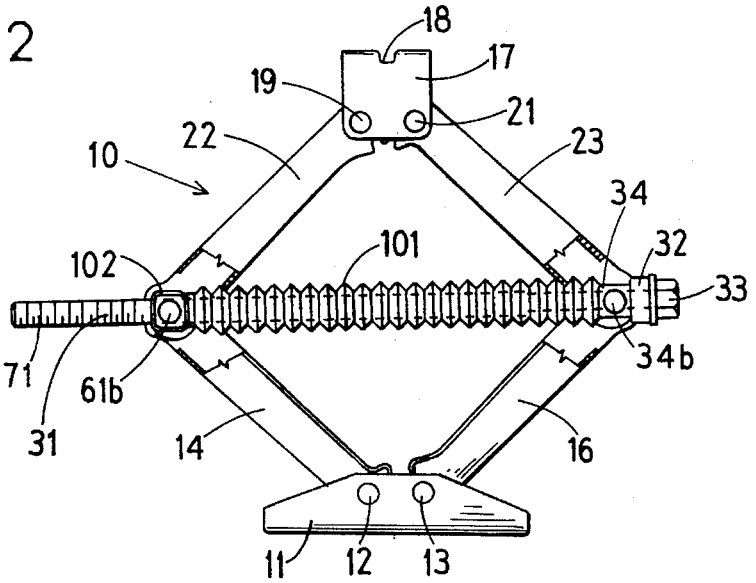
FIG. 2 is a side plan view of a scissors jack of the present invention in a partially raised position.
Figure 4:
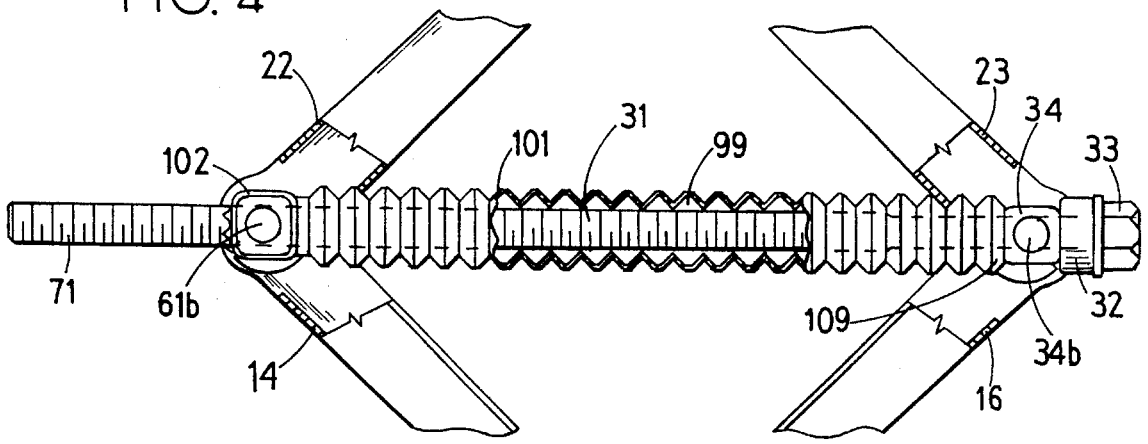
FIG. 4 is a cut-away partially sectional view illustrating the flexible bellows of the invention.
Figure 5:
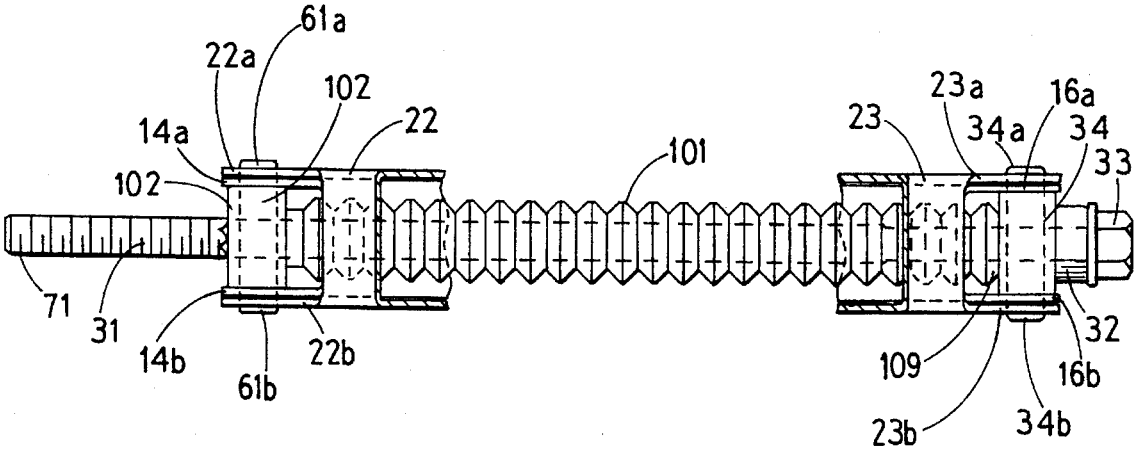
FIG. 5 is a top sectional view illustrating the flexible bellows of the invention.

FIGS. 1 and 2 illustrate a scissors jack 10 with FIG. 1 illustrating it in retracted or down position and FIG. 2 illustrating it in the partially extended position. The jack 10 comprises a base 11 which pivotally supports lower channel members 14 and 16 which are connected by pivot pins 12 and 13 to the base 11. A support 17 which has a vehicle engaging slot 18 is pivotally attached to upper channel members 22 and 23 by pivot pins 19 and 22. A hollow trunnion 61 has pivot shaft portions **61*a* and 61*b* that extend from opposite ends which pivotably connects the lower ends 22*a* and 22*b* of the channel member 22 and the upper ends 14*a* and 14*b* of the channel member 14. The hollow trunnion 61 is formed with a threaded opening through which the lead screw 31 is threadedly received and the lead screw 31 has an end 71 which extends when the jack is raised as illustrated in FIGS. 2, 4 and 5. A solid trunnion 34 has extending ends 34*a* and 34*b* which pivotably connect the upper ends 16*a* and 16*b* of the lower channel 16 to the lower ends 23*a* and 23*b* of the upper channel 23. The trunnion 34 has an extending portion 32 through which an unthreaded portion of lead screw 31 extends and a hexagonal head 33 is attached to the outer end of the lead screw and can be rotated to turn the lead screw 31 so as to raise and lower the jack. It is to be realized, of course, that a jack handle with a suitable socket is receivable on the head 33 to turn the lead screw 31** to raise and lower the jack. When not in use, the handle is detachable and is stored in a suitable location.

Figure 3:
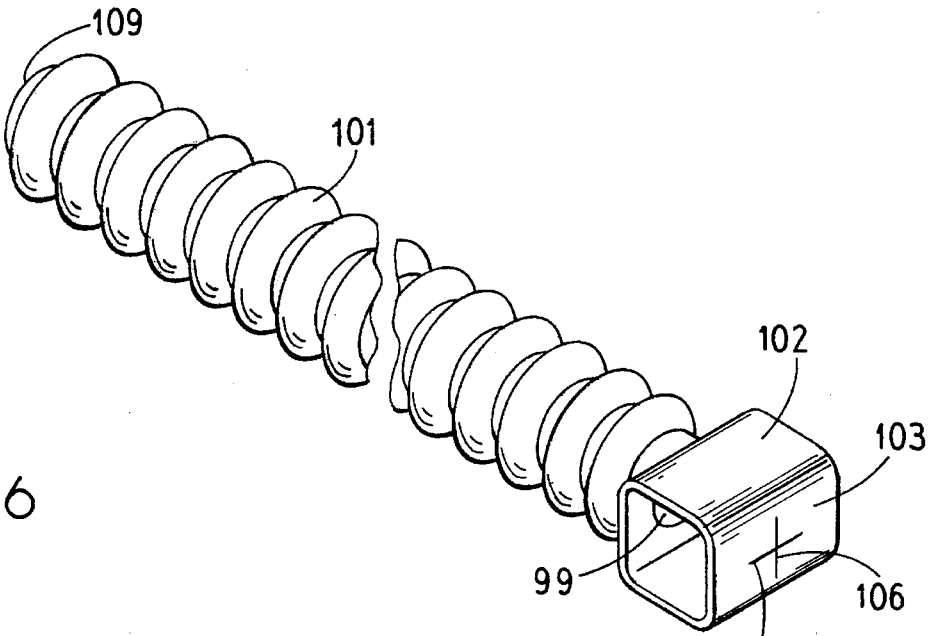
FIG. 3 is a perspective view of the protective flexible bellows of the invention.

A flexible bellow 101 which may be made of plastic or rubber or other suitable material has a central opening 99 through which the lead screw 31 extends and has a generally square head portion 102 as best illustrated in FIG. 3 which has opposite ends open and which bear against the ends of the upper and lower channel members 14 and 22. In the front face 103 of the head portion 102, transverse slits 104 and 106 are formed which cross each other. The end 71 of the lead screw 31 extends through slits 104 and 106 when the lead screw is extended beyond the confines of the hollow trunnion 61 as the jack is raised.

FIGS. 1, 2, 4 and 5 illustrate the flexible bellows 101 mounted on the lead screw 31 of the jack and with the head portion 102 enclosing the hollow trunnion 61 and the other inner end of the bellows 109 abutting against the solid trunnion 34.

The flexible bellows 101 maintains lubricant such as grease on the lead screw 31 and provides a reservoir of lubricant such that as the lead screw 31 is extended and retracted through the threaded trunnion 61, the threads of the lead screw 31 and the trunnion 61 will be lubricated so that the jack works smoothly.

It is another objective of the flexible bellows 101 to prevent the user of the jack from coming in, contact with the greasy lead screw 31 which would soil the hands and clothes of the user. Also, the flexible bellows 31 prevents, dirt, water and other contaminants from coming in contact with the lead screw 31. Such substances would remove the lubricant from the lead screw 31 and it would corrode and become rusty and dirty with sand or soot which would grind and wear the threads of the lead screw 31 and of the threaded trunnion 61. The invention provides a protective grease seal and bellows 101 which encloses the lead screw 31. The protective bellows 101 makes it possible to store the jack in external exposed positions of the vehicle since the bellows protects and lubricates the lead screw of the jack.

Figure 6:
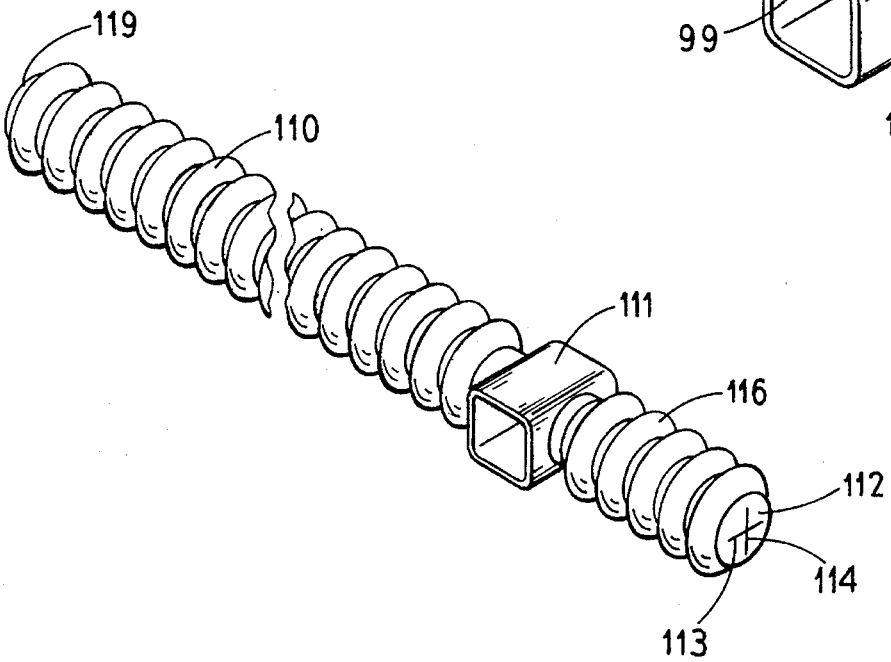
FIG. 6 is a perspective view illustrating a modified form of the invention.

FIG. 6 illustrates a modified form 110 of the flexible bellows which has an end 119 that engages the solid trunnion 64 and has a flexible head portion 111 which fits around the threaded trunnion 61. An additional flexible bellows portion 116 extends from the portion 111 as shown in FIG. 6 and has a closed end 112 formed with slots 113 and 114 through which the threaded end 71 of the lead screw 31 extends as the jack is raised. In both of the embodiments shown in FIG. 3 and FIG. 6, when the lead screw is retracted, the slits 104 and 106 in FIG. 3 and the slits 113 and 114 in FIG. 6 close to seal the bellows 101 and 110 over the lead screw 31 so that it is protected when the jack is stored. In the embodiment of FIG. 6, the end 112 may be solid without slots so as to enclose the end 71 of the lead screw 31. In this case, the flexible bellows 116 accommodate the varying length of the lead screw end 71.

It is seen that this invention provides a new and novel scissors jack with a flexible bellows that maintains lubrication and keeps the lead screw lubricated and clean, and although the invention has been described with respect to preferred embodiments, it is not to be so limited as changes and modifications can be made therein which are within the full intended scope as defined by the appended claims.

I claim as my invention:

1. A scissors jack comprising, a base member, first and second lower channel members with their lower ends pivotally connected to said base member, a support member, first and second upper channel members with their upper ends pivotally connected to said support member, a threaded trunnion which pivotally connects the lower end of said first upper channel member to the upper end of said first lower channel member, an unthreaded trunnion which pivotally connects the lower end of said second upper channel member to the upper end of said second lower channel member, a threaded opening formed through said threaded trunnion and an unthreaded opening formed through said unthreaded trunnion, a lead screw formed with a threaded portion receivable in said threaded opening of said threaded trunnion and an unthreaded portion receivable through said unthreaded opening of said unthreaded trunnion, and a flexible bellows of plastic mounted on said lead screw to maintain lubricant on said lead screw and through which said lead screw extends between said threaded and unthreaded trunnions, a generally square head portion of said flexible bellows extends over said threaded trunnion and has a front face formed with two slits at right angles to each other through which said lead screw can extend and said slits close when said lead screw is withdrawn from said slits and said flexible bellows of plastic prevents lubricant from contacting a user of the jack.

2. A scissors jack comprising, a base member, first and second lower channel members with their lower ends pivotally connected to said base member, a support member, first and second upper channel members with their upper ends pivotally connected to said support member, a threaded trunnion which pivotally connects the lower end of said first upper channel member to the upper end of said first lower channel member, an unthreaded trunnion which pivotally connects the lower end of said second upper channel member to the upper end of said second lower channel member, a threaded opening formed through said threaded trunnion and an unthreaded opening formed through said unthreaded trunnion, a lead screw formed with a threaded portion receivable in said threaded opening of said threaded trunnion and an unthreaded portion receivable through said unthreaded opening of said unthreaded trunnion, and a flexible bellows of plastic mounted on said lead screw to maintain lubricant on said lead screw and through which said lead screw extends between said threaded and unthreaded trunnions, a generally square head portion of said flexible bellows extends over said threaded trunnion and has a front face formed with an opening through which said lead screw can extend wherein a an additional bellows of flexible plastic material is attached to said square head portion of said flexible bellows and said additional flexible bellows covers the end of said lead screw when it extends from said square head portion, and wherein said additional flexible bellows is formed with an opening through which said lead screw can extend.

* * * * *

UNITED STATES PATENT AND TRADEMARK OFFICE

CERTIFICATE OF CORRECTION

PATENT NO. : 5,458,316
DATED : October 17, 1995
INVENTOR(S) : Darryl L. Engel

It is certified that error appears in the above-indentified patent and that said Letters Patent is hereby corrected as shown below:

In Column 3, line 19, correct "in, contact" to read --in contact--.

Signed and Sealed this

Eleventh Day of June, 1996

*Attest:*

Bruce Lehman

BRUCE LEHMAN

*Attesting Officer*

*Commissioner of Patents and Trademarks*